US007228940B2

(12) United States Patent
Stringer

(10) Patent No.: US 7,228,940 B2
(45) Date of Patent: Jun. 12, 2007

(54) SCAFFOLD HAVING A REPLACEABLE LOCKING AND SECURING DEVICE

(75) Inventor: Matthew D. Stringer, Archbold, OH (US)

(73) Assignee: bil-jax, inc., Archbold, OH (US)

( * ) Notice: Subject to any disclaimer, the term of this patent is extended or adjusted under 35 U.S.C. 154(b) by 431 days.

(21) Appl. No.: 10/916,357

(22) Filed: Aug. 11, 2004

(65) Prior Publication Data

US 2006/0054396 A1 Mar. 16, 2006

(51) Int. Cl.
*E04G 7/00* (2006.01)
*E04G 1/00* (2006.01)

(52) U.S. Cl. ..... 182/178.5; 182/178.1; 182/179.1; 182/186.8; 403/49; 248/221.11

(58) Field of Classification Search ..... 182/178.5, 182/186.8, 186.3, 186.7, 178.3, 178.6, 178.1, 182/179.1; 248/221.11, 220.21, 235; 403/49, 403/230, 386; 24/573.09; 411/351; 52/637, 52/638, 656.9, 651.1, 655.1
See application file for complete search history.

(56) References Cited

U.S. PATENT DOCUMENTS 2,658,776 A * 11/1953 Wilcox ..... 403/49
2,963,679 A * 12/1960 Jugle ..... 403/386
4,189,810 A * 2/1980 Beziat ..... 403/49
4,437,791 A * 3/1984 Reynolds ..... 403/386
4,632,221 A * 12/1986 Stanford ..... 182/186.8
5,474,270 A * 12/1995 Rixen et al. ..... 248/221.11
5,785,447 A * 7/1998 Fonti et al. ..... 403/49
5,887,836 A * 3/1999 Back ..... 248/221.11
5,988,317 A * 11/1999 Riding ..... 182/178.5

FOREIGN PATENT DOCUMENTS

GB 2011008 A * 9/1979

* cited by examiner

*Primary Examiner*—Hugh B. Thompson, II
(74) *Attorney, Agent, or Firm*—Emch, Schaffer, Schaub & Porcello Co., L.P.A.

(57) ABSTRACT

A replaceable locking and securing device for securing a first member to a second member includes a replaceable bracket, a lock and a fastener. The bracket defines one opening when the bracket is operatively connected to the first member.

18 Claims, 4 Drawing Sheets

SCAFFOLD HAVING A REPLACEABLE LOCKING AND SECURING DEVICE

FIELD OF THE INVENTION

The present invention relates to a scaffold having a replaceable locking and securing device for attaching sections of a scaffolding together.

BACKGROUND OF THE INVENTION

Scaffolds are used in many situations to provide an elevated platform for workers. Most scaffolding is made of tubular metal which is welded together to have vertical legs with horizontal rungs extending between the legs to form a ladder-like vertically extending supporting structure. Horizontally positioned platforms are held on side rails which are mounted to the vertically extending support structures.

Since scaffolding is often moved between work stations or is added to as work is completed, it is desired to design and construct scaffolding that is easy to assemble and disassemble and which also is very secure. It is also desired to have scaffolding which is economical to manufacture and is easily collapsed, stored and moved from one work location to another.

These assembled scaffolding structures need to have secure locking mechanisms so that the horizontal structures and the vertical structures do not move relative to each other during use.

Many types of latch mechanisms have been used to secure the horizontal platform to the vertical supporting structure. Examples of several of these efforts are shown in U.S. Pat. Nos. 409,167; 4,793,438; 5,028,164; 5,390,761; 5,931,260; 6,202,788 B1 and 6,273,831 B1.

One problem with the current latch mechanisms for scaffolding is that if the latch or lock becomes damaged, the lock is difficult to replace. Currently the locks are welded onto the frame of the scaffolding. If the lock becomes damaged due to use or rust, for example, it is difficult and dangerous to replace the lock.

Another problem with current locks is that after welding of the lock to the frame, the entire lock and frame is protected from rust or damage by galvanizing the lock and frame. The zinc galvanizing compounds tend to "pool" or fill up the holes in the locks. The manufacturer must then clean the excess galvanizing material from the lock openings. This extra step is expensive and time consuming. Further, possible damage or inadvertent removal of too much galvanizing material can occur to the lock and/or frame.

Yet another problem is that many current scaffolding is that various popular styles of locks, often referred to as T-locks, cannot be used on a galvanized frame. Further, many different types of locks are requested by end users such as T-locks, J-locks and F-locks. The manufacturer must prepare different batches of parts and have each part welded to the locks frame. This causes additional time, expense and inventory for the manufacturer.

Further, since locks need to be extremely strong and durable, it is often desirable to sometimes make the lock out of a different type of material than the scaffolding frame itself. However, welding different types of material is often difficult and, sometimes, impossible.

Yet another problem with currently available locks is the need for increasing the safe use and operation of the scaffold. Failure of the lock causes catastrophic damages both to the scaffolding and workers. Therefore, there is a need to have a lock which has built-in safety features which would fail prior to any catastrophic failure.

Additional problems occur, as described above, with respect to the need for multiple types of parts in order to assemble and use a lock on a scaffold. The many types of designs alternatives and the locking pins or latches used therewith are often lock specific. That is, only one type of lock or latching pin can be used. If the manufacturer or end use customer does not have the correct part for the lock, valuable time, money and other resources are lost while waiting for such specific replacement part.

Yet another problem occurs during end use of the scaffold. Often the scaffolds are assembled in awkward or dangerous locations. The worker must be extreme agile to both support and assemble a lock using multiple parts. Often the lock is difficult to assembly due to clearance constraints both for maneuvering the scaffold frame itself and for having access to the lock mechanism in order to fully secure the frame sections together.

Still other problems with the currently used latches occur since the scaffoldings are often used in construction and other work environments where material such as work equipment, debris or supplies are constantly being moved onto and off of the scaffolding. It is important to have a locking and securing mechanism which cannot be accidentally disengaged and further which does not interfere with the movement of the worker, worker's tools or supplies, or any debris or materials being moved by the worker.

It is therefore an object of the present invention to provide a locking and securing mechanism that is easily secured and, further, is held in a secured locking position.

It is a further object of the present invention to provide a locking and securing mechanism that can be used with currently available horizontal support structures and vertical support structures of a scaffolding system.

It is a further object of the present invention to provide a locking and securing mechanism which is easily replaceable on the scaffold if damage should happen to occur to the locking and securing mechanism.

It is a further object of the present invention to provide a locking and securing mechanism which is inexpensive to manufacture and, further, readily allows the locking and securing mechanism to be fully coated with a galvanizing or other suitable material after installation of the locking and securing mechanism on a scaffold.

It is yet another object of the present invention to provide a locking and securing mechanism which is strong and resistant to breakage or shearing.

It is another object of the present invention to provide a scaffolding which is easy to be assembled and disassembled while also providing a strong and secure work surface for a worker.

Additional objects, features and advantages of the present invention will become apparent to those skilled in the art upon consideration of the following detailed description of a preferred embodiment as described herein.

SUMMARY OF THE INVENTION

A device for locking and securing a first support member to a second support member is described. The locking and securing device includes a bracket, a replaceable lock, and a fastener for securing the replaceable lock to the bracket. The fastener can be secured in the bracket with a securing pin.

In another embodiment, the present invention relates to a scaffolding system comprises at least one first, or horizontal, support member and at least one second or vertical, support member and a replaceable locking and securing device lock for securing and locking the horizontal support member to the vertical support member.

According to one aspect, the present invention relates to a bracket for use in replaceable locking and securing device for securing a first member to a second member. The bracket includes a first engagement section and a second engagement section. Each of first and second engagement sections have an outer depending section and an opposing inner depending section where the outer and inner depending sections are in an opposed parallel relationship. The outer depending section extends at a first distance and the inner depending section extends a second distance such that the first distance is greater than the second distance. Also, the outer depending section has a length greater than the length of the inner depending section. At least one passageway extends through the bracket.

In another aspect, the present invention relates to a replaceable locking and securing device for securing a first member to a second member and includes a bracket having a first engagement section and a second engagement section. Each of first and second engagement sections has an outer depending section and an opposing inner depending section where the outer and inner depending sections are in an opposed and parallel relationship to each other. The outer depending section extends at a first distance and the inner depending section extends at a second distance such that the first distance is greater than the second distance and such that the outer depending section has a length greater than the length of the inner depending section. The bracket defining one interior passageway extending therethrough when the bracket is operatively connected to the first member.

The replaceable locking and securing device further includes a lock having at least one flange for matingly engaging the bracket. The lock has at least one opening extending through the flange such that a bracket opening and a lock opening are in coaxial alignment when the lock is matingly engaged with the bracket.

The replaceable locking and securing device further includes at least one fastener being axially positionable through the passageway in the bracket and through the opening in the lock.

In certain embodiments, the lock has first and second opposing flanges which are in a parallel and spaced apart relationship to each other. The first flange defines at least one first opening extending therethrough and the second flange defines at least one second opening therethrough, the first opening in the first flange and the second opening in the second flange being in coaxial alignment.

In certain embodiments, the first flange has a third opening in opposed relationship to the first opening, and the second flange has a fourth opening in opposed relationship to the second opening. The first opening is axial alignment with the second opening along a first axis and the third opening is in axial alignment with the fourth opening along a second axis.

In certain embodiments, the first engagement section is operatively connected to the second engagement section by a center section such that the inner depending section of each of the first and second engagement sections are operatively connected to the center section. The locking and securing device can have a suitable coating material on an inner surface and an outer surface of the bracket such as, for example, a galvanizing material.

In certain embodiments, the replaceable lock further includes a securing flange positioned on at least one depending flange where the securing flange defines an axially extending opening for receiving a securing member for securing the fastener to the replaceable lock. The fastener can comprise a pair of opposing pins positioned in spaced apart and parallel relationship. Also, in certain embodiments, the opposing pins are operatively connected with a connecting section whereby, when the fastener is axially aligned with the replaceable lock and bracket, the connecting section is in a parallel relationship with the securing flange for receiving the securing member.

In certain embodiments, the present invention further relates to a scaffold having a securing and locking device for securing a first member to a second member as described above.

In certain embodiments, the present invention further relates to a method for making a scaffold having a replaceable locking and securing device for securing a first member to a second member. The method includes at least the steps of: operatively connecting the outer depending sections of the bracket to the first member whereby the bracket defines one passageway extending therethrough when the bracket is operatively connected to the first member, and applying a suitable coating material to the bracket and to at least a portion an outer surface of the first member.

DESCRIPTION OF THE PREFERRED EMBODIMENT

Figure 1:
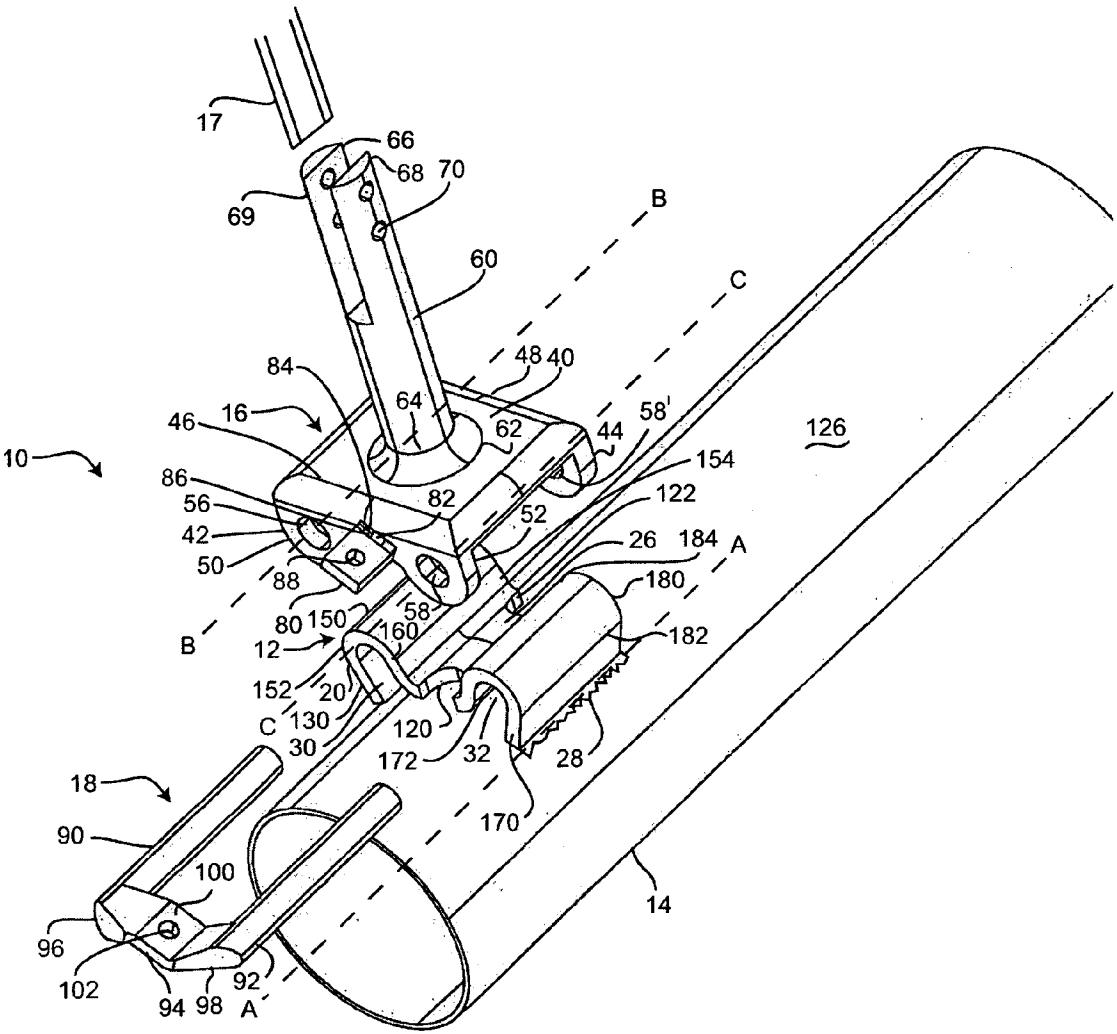
FIG. 1 is a perspective view of a replaceable locking and securing device positioned on a support structure in an unassembled, or exploded, view.

Referring to FIG. 1, an exploded perspective view of the scaffold brace lock 10 of the present invention is generally shown. The lock includes a bracket 12, a replaceable lock 16, and at least one fastener 18. FIG. 1 shows an unassembled state where the bracket 12 is operatively connected to a first member, such as a frame or first support structure, 14. The replaceable lock 16 is in a spaced apart relationship to the bracket 12. A second member 17, such as a second frame or support structure, is shown in axial alignment with the replaceable lock 16. A fastener 18 is shown in axial alignment with the bracket 12 in an unengaged position.

The bracket 12 is oriented on the support structure 14 in an axial direction, as shown by axis A in FIG. 1. The bracket 12 has a first engagement section 20 and a second engagement section 22. The first and second engagement sections 20 and 22 are operatively connected by a center section 26. In the embodiment shown, the bracket 12 can be formed of a unitary material and formed to have a generally "W" shape. In certain embodiments, the bracket 12 is made of a material that can be readily welded to the support structure 14 by a weld 28. It is to be understood that various suitable types of material can be used to form the bracket 12.

The engagement sections 20 and 22 define open channels or passageways 30 and 32, respectively. The passageways 30 and 32 are sufficiently open and have an interior volume that is sufficiently large to allow a suitable coating material, such as for example, a paint or galvanizing material, to readily flow through the channels 30 and 32. In certain embodiments, these channels 30 and 32 have an interior dimension of about 5 to 10 mm in width and a height of about 5 to about 10 mm. The interior dimensions of the channels are dependant upon the size of bracket used and the diameter of the post or support to which the bracket is being operatively connected or welded.

The replaceable lock 16 is positioned adjacent the bracket 12, as will be described in detail below. The bracket 12 can accept different replaceable locks 16 such that if a replaceable lock 16 is damaged or if a different type of lock is desired, the replaceable lock 16 can be disengaged from the bracket and a new replaceable lock can be positioned on the bracket, as will be further explained in detail below.

The replaceable lock 16 includes a base section 40, at least one first depending flange section 42 and at least one second, opposing, flange section 44. The flange sections 42 and 44 depend from the base section 40 at right angles from a plane defined by the base section 40. The flange 42 extends from a first edge 46 of the base section 40 while the second flange 44 extends in a perpendicular direction from a second edge 48. The first and second edges 46 and 48 are in opposed and parallel relationship to each other. The depending flanges 42 and 44 are also in parallel alignment.

Each flange can be generally similar in construction; therefore, for ease of discussion and illustration herein, only one flange 42 will be discussed in detail. It should be understood that the opposing flange 44 can have the same features. The depending flange 42 has first and second sections or lobes 50 and 52. Each lobe defines an opening 56 and 58, respectively. The openings 56 and 58 extend in a general axial direction. That is, as shown in FIG. 1, axis B extends through the opening 56 and an opposing opening 56' (not shown) in the second flange 44. Similarly, axis C extends through the opening 58 in flange 42 and an opposing opening 58' in the second flange 44. The axes B and C are parallel to the longitudinal axis A extending through the support structure 14. The openings 56 and 58 and opposing openings 56' and 58' can have any desired interior diameter or shape, as will be discussed in detail below.

The replaceable lock 16 further includes a lock section 60 which extends in a perpendicular direction from the base section 40 in a direction opposite the depending flanges 42 and 44. The lock section 60 is operatively connected to the base section 40 by a suitable weld or other means 62 at its first end 64. The lock section 60 has an opposing or second end 66. In the embodiment shown, the lock section 60 is a "T-lock"; however, it should be understood that other types of lock sections can be used and that such locks sections are within the contemplated scope of the present invention. Examples of such suitable lock sections include "F-locks" and "J-locks". Referring again to the Figures, in a T-shape lock section 60 has opposing semi-circular flange sections 68 and 69 having at least one or more openings 70 extending at a perpendicular direction therethrough. It is to be understood that other types of locks such as "J-locks", "F-locks" and the like are useful with the present invention and can be operatively connected by weld or other means 62 to the base section 40.

In one embodiment, the replaceable lock 16 further includes a securing flange 80 that is positioned on the flange 42. The securing flange 80 can be positioned between the lobes 50 and 52 of the flange 42. In the embodiment shown, the securing flange 80 is generally positioned at an acute angle with respect to the plane defined by the base section 40 of the replaceable lock 16. The securing flange 80 is operatively connected to the flange 42 by a suitable weld 82 at a first end 84 of the securing flange 80. The securing flange 80 defines a surface 86 having an axially extending opening 88 therethrough. The opening 88 extends in a perpendicular direction through the securing flange 80 from a plane defined by the surface 86.

In the embodiment shown, the locking and securing device 10 further includes at least one fastener means 18. It is to be understood that various embodiments of the present invention can use fastener means having different configurations and such configurations are considered to be within the scope of the various embodiments of the present invention.

Referring now to the embodiment shown in FIG. 1, the fastener means 18 generally includes a pair of opposing pins 90 and 92 positioned in a spaced apart and parallel relationship. The pin 90 has a cross-sectional diameter which allows the pin 90 to be positioned within the passageway 30 defined by the engagement section 20. Similarly, the pin 92 has cross-sectional area which allows the pin 92 to be positioned within the passageway 32 defined by the engagement section 22. In the embodiment shown, the fastener means 18 further includes a connecting section 94 which operatively connects the pin 90 to the pin 92 at a first end 96 of the pin 90 and a first end 98 of the pin 92. In the embodiment shown, the connecting section 94 is positioned at an acute angle with respect to an axis defined through each longitudinally extending pin 90 and 92, respectively. The connecting section 94 has a planar section 100 and defines an axially extending opening 102 which is perpendicular to a plane defined by the planar section 100. The first ends 96 and 98 are positioned at an acute angle with respect to the plane defined by section 100. The first end 96 depends in a downward direction from the center section 94 while the second section 98 extends in an upward direction from the plane defined by the section 100.

Figure 2:
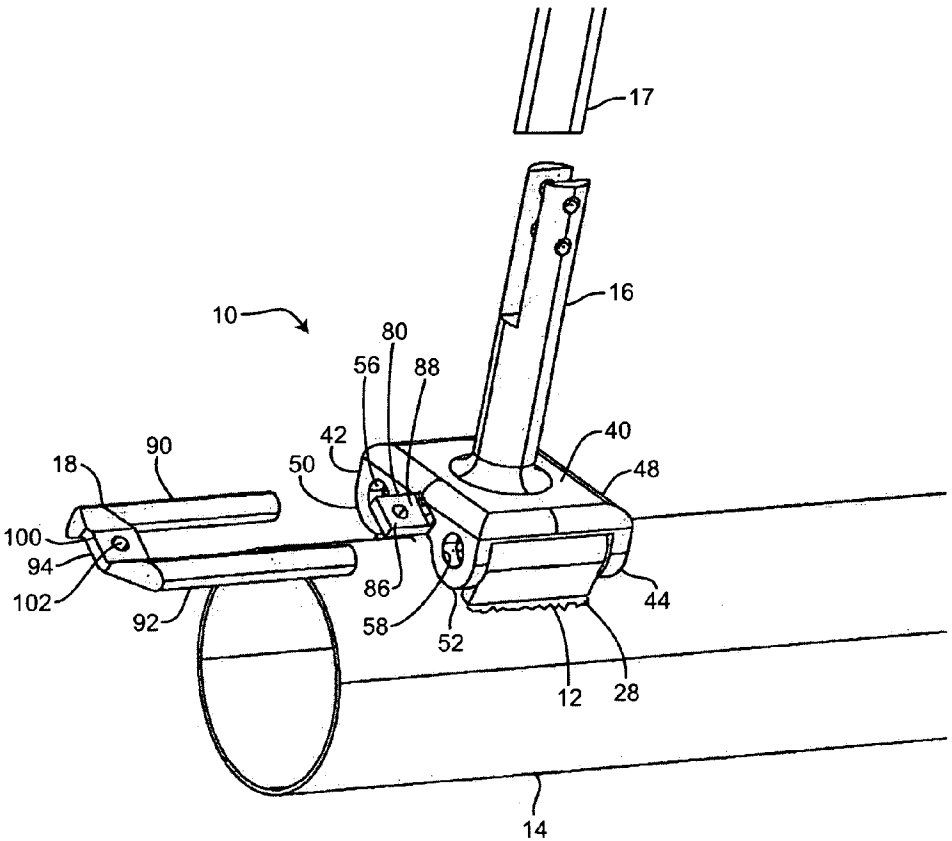
FIG. 2 is a perspective view of the device of FIG. 1 partially installed on a support structure.

Referring now to FIG. 2, partial assembly of the present invention is shown. The replaceable lock 16 is positioned over the bracket 12 such that the openings 56 and 56' in the flanges 42 and 44 are in coaxial alignment with the passageway 30 in the lock 16 while the openings 58 and 58' in the flanges 42 and 44 are in coaxial alignment with the passageway 32. That is, the axis B and axis C now extend in a parallel direction through the openings 56, 56' and passageway 30 while axis C extends through openings 58, 58' and passageway 32.

Figure 3:
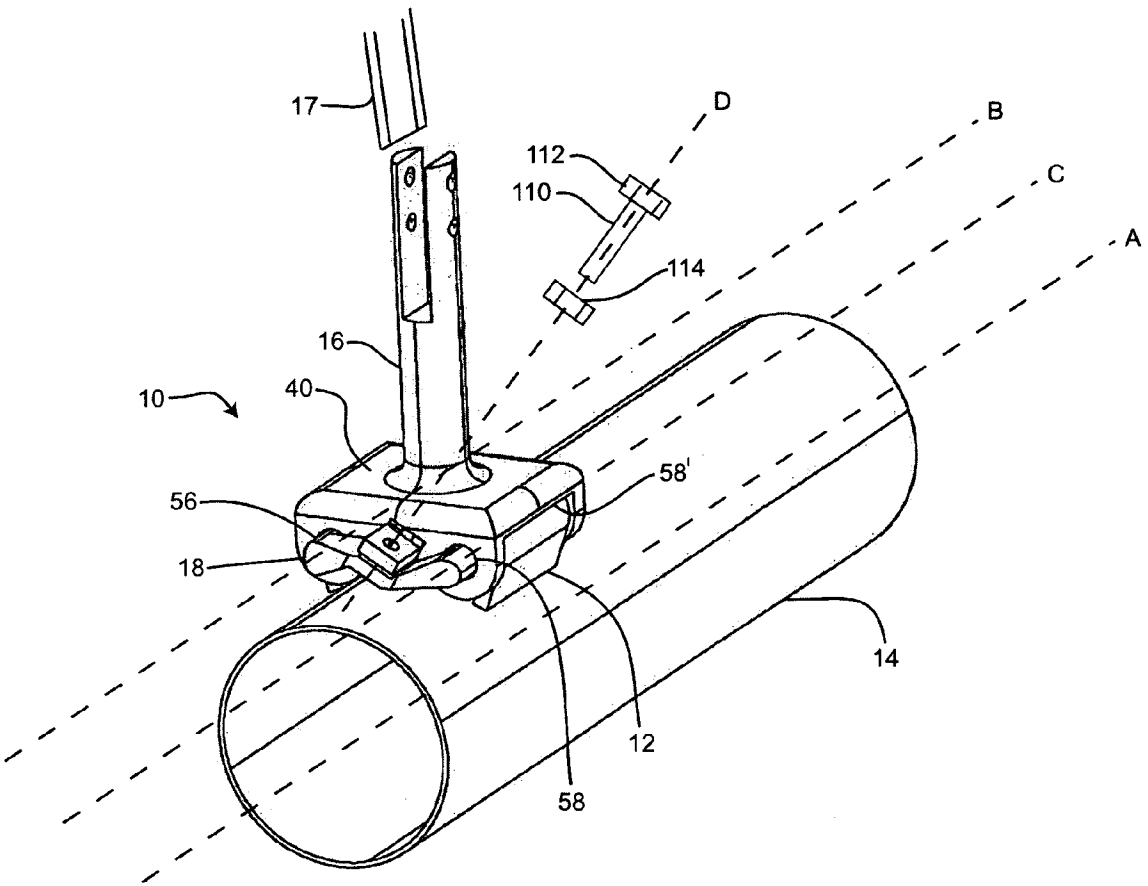
FIG. 3 is a perspective view of the device of FIGS. 1 and 2, showing the replaceable locking and securing device in a locked position.

Referring now to FIG. 3, during assembly of the scaffold, the fastener means 18 is axially positioned within the replaceable lock 16 and bracket 12. The first pin 90 is now in coaxial alignment with the axis B and extends through the opening 56, passageway 30 and opening 56'. Similarly, the second pin 92 is coaxial alignment with axis C and extends through opening 58, passageway 32 and opening 58'.

The securing flange 80 of the replaceable lock 16 and the center section 94 of the fastener 18 are in a parallel relationship at an acute angle with respect to the plane defined by base section 40 of the replaceable lock 16. The opening 82 in the securing flange 80 and the opening 102 in the center section 94 of the fastener 18 are in axial alignment along an axis D. A suitable securing member 110 such as a bolt 112 and nut 114 can be used to secure the fastener 18 to the replaceable lock 16. In the embodiment shown, the bolt 112 extends through the openings 82 and 102 and the nut 114 is positioned at a second end of the bolt 112 in a position opposite the securing flange 80.

As best seen in FIG. 1, the replaceable lock 16 can have opposing cut-away sections 120 and 122 in the center section 26 such that the bolt or other securing member 110 can be readily positioned within the securing flange 80 and center section 94. When the lock 10 is operatively secured or welded to the support structure 14, the center section 26 is in a spaced apart relationship from an outside surface 126 of the support structure 14.

Figure 4:
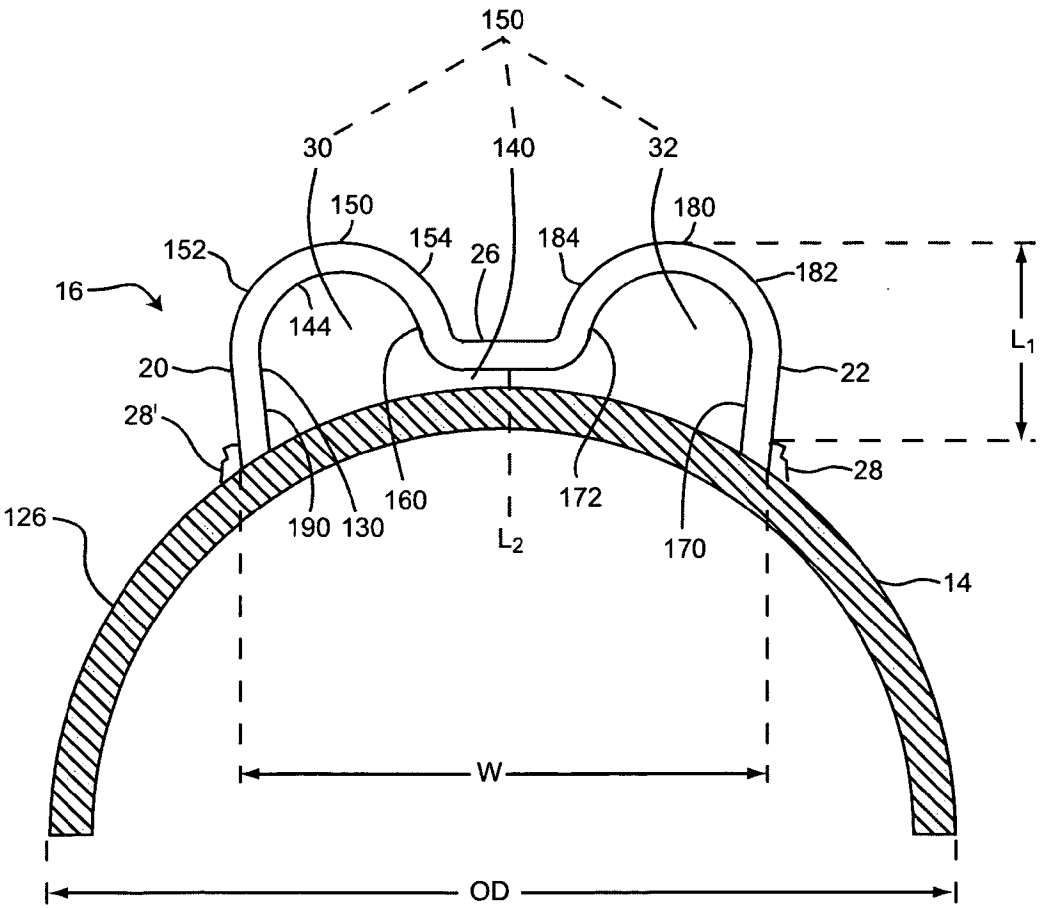
FIG. 4 is an end elevational view, partially in cross-section, showing a bracket of the locking and securing device positioned on a support structure.

As seen in FIG. 4, the first engagement section 20 of the bracket 12 has an outer depending section 130 operatively connected to, or integrally formed with, a middle or center section 150 at a first, or outer edge 152. The first engagement section 20 has a inner depending section 160 operatively connected to, or integrally formed with, a second edge 154 of the middle or center section 150. The outer depending section 130 and the inner depending section 160 of the first engagement section 20 are in an opposed and parallel relationship. Similarly, the second engagement section 22 of the bracket 12 has an outer depending section 170 operatively connected to, or integrally formed with, a middle or center section 180 at a first, or outer edge 182. The second engagement section 22 further has an inner depending section 172 operatively connected to, or integrally formed with, a second edge 184 of the middle or center section 180. The outer depending section 170 and the inner depending section 172 of the second engagement section 22 are in an opposed and parallel relationship.

In the embodiment shown, the first engagement section 20 and the second engagement section 22 have the same geometry. It should be understood that, in other embodiments, the engagement sections 20 and 22 can have dissimilar internal and external geometries such that, while FIG. 4 generally shows barrel shaped or similarly rounded interior sections 144, other embodiments of the present invention can have other internal geometries which also readily accept different shaped fastener means 18.

Referring again to FIG. 4, the outer depending section 130 of the first engagement section 20 of the bracket 12 extends from the middle section 150 of the first engagement section 20 at a first distance L. The inner depending section 160 depends from the middle section 130 at a second distance L2. The first distance L1 is greater than the second distance L2 such that the outer depending section 130 has a length greater than the length of the inner depending section 160. When the bracket 12 is operatively connected or welded at welds 28 and 28' to the support structure 14, the bracket 12 defines an interior space 150 as defined by passageway 30, central space 140 and passageway 32 and by a portion of the exterior surface 126 of the support structure 14.

The interior passageway or space 152 allows a suitable coating material 190, such as a galvanizing material 190, to be coated on an interior surface 144 of the lock 16 and a portion of the exterior surface 126 of the support structure 14. The interior space 150 is readily accessible by the galvanizing material 190 when the bracket 12 is operatively connected or welded to the support structure 14.

In the embodiment shown, the bracket 12 is stamped or formed of a unitary piece of steel or other suitable material which can be readily welded to the support structure 14. The bracket 12 is sufficient robust to withstand relatively high forces put upon the bracket during use. In such embodiment, the bracket 12 is formed or stamped such that the bracket 12 has generally a geometry as shown in FIG. 4 with outer depending sections 130 and 170 having lengths greater than the inner depending sections 160 and 172, respectively. It should be noted that in the schematic illustration of the bracket 12 shown in FIG. 4, no recessed or cut-away sections 120 and 122 are shown for ease of illustration.

The bracket 12 generally has a preferred width W which allows the bracket 14 to be readily operatively connected to the support structure 14 without protruding beyond the outside diameter OD of such support structure 14. The bracket 12 can have a generally symmetrical shape which allows the bracket 12 to be easily oriented for welding or attachment to the support structure 14. The bracket is resistant to weld shrinkage. The bracket can have a desired shape and dimension which can be used to accept many different shapes and sizes of replaceable locks and/or fasteners.

Although the invention has been described in detail with reference to a certain preferred embodiment, variations and modifications exist within the scope and spirit of the invention as described and defined in the following claims.

I claim:

1. A replaceable locking and securing device for securing a first member to a second member comprising:

a bracket comprising a first engagement section and a second engagement section, each of first and second engagement sections having an outer depending section and an opposing inner depending section; the outer and inner depending sections being in an opposed and parallel relationship;

the outer depending section extending at a first distance and the inner depending section extending at a second distance, the first distance being greater than the second distance such that the outer depending section has a length greater than the length of the inner depending section;

the bracket defining one interior passageway extending therethrough when the bracket is operatively connected to the first member;

a lock having at least one flange for matingly engaging the bracket, the lock having at least one opening extending through the flange such that the bracket passageway and the lock opening are in coaxial alignment when the lock is matingly engaged with the bracket, and at least one fastener being axially positionable through the passageway in the bracket and through the opening in the lock.

2. The locking and securing device of claim 1, wherein the lock comprises first and second opposing flanges, the first and second flanges being in parallel and spaced apart relationship, the first flange defining at least one first opening extending therethrough and the second flange defining at least one second opening therethrough, the first opening in the first flange and the second opening in the second flange being in coaxial alignment.

3. The locking and securing device of claim 2, wherein the first flange further has a third opening in opposed relationship to the first opening, wherein the second flange further has a fourth opening in opposed relationship to the second opening, the first opening being axial alignment with the second opening along the first axis and the third opening being in axial alignment with the fourth opening along the second axis.

4. The locking and securing device of claim 1, wherein the first engagement section is operatively connected to the second engagement section by a center section, wherein the inner depending section of each of the first and second engagement sections are operatively connected to the center section.

5. The locking and securing device of claim 1, having a coating material on an inner surface and an outer surface of the bracket.

6. The locking and securing device of claim 5, wherein the coating material is a galvanizing material.

7. The locking and securing device of claim 1, wherein the replaceable lock further includes a securing flange positioned on at least one depending flange, securing flange defining an axially extending opening for receiving a securing member for securing the fastener to the lock.

8. The locking and securing device of claim 1, wherein the fastener comprises a pair of opposing pins positioned in spaced apart and parallel relationship.

9. The locking, and securing device of claim 8, wherein the opposing pins are operatively connected with a connecting section whereby, when the fastener is axially aligned with the replaceable lock and bracket, the connecting section is in a parallel relationship with the securing flange for receiving the securing member.

10. A scaffold having a securing and locking device for securing a first member to a second member comprising:

a bracket comprising a first engagement section and a second engagement section, each of first and second engagement sections having an outer depending section, and an opposing inner depending section; the outer and inner depending sections being in an opposed and parallel relationship, the outer depending section extending at a first distance and the inner depending section extending at a second distance, the first distance being greater than the second distance such that the outer depending section has a length greater than the length of the inner depending section;

the bracket defining one interior passageway extending therethrough when the bracket is operatively connected to the first member;

a lock having at least one flange for matingly engaging the bracket, the lock having at least one opening extending through the flange such that the bracket opening and the lock opening are in coaxial alignment when the lock is matingly engaged with the bracket, and at least one fastener being axially positionable through the passageway in the bracket and through the opening in the lock.

11. The scaffold of claim 10, wherein the lock comprises first and second opposing flanges, the first and second flanges being in parallel and spaced apart relationship, the first flange defining at least one first opening extending therethrough and the second flange defining at least one second opening therethrough, the first opening in the first flange and the second opening in the second flange being in coaxial alignment.

12. The scaffold device of claim 11, wherein the lock further includes a securing flange positioned on at least one depending flange, securing flange defining an axially extending opening for receiving a securing member for securing the fastener to the lock.

13. The scaffold device of claim 11, wherein the fastener comprises a pair of opposing pins positioned in spaced apart and parallel relationship.

14. The scaffold device of claim 13, wherein the opposing pins are operatively connected with a connecting section whereby, when the fastener is axially aligned with the lock and bracket, the connecting section is in a parallel relationship with the securing flange for receiving the securing member.

15. The scaffold of claim 10, wherein the first flange further has a third opening in opposed relationship to the first opening, and wherein the second flange further has a fourth opening in opposed relationship to the second opening, the first opening being axial alignment with the second opening along the first axis and the third opening being in axial alignment with the fourth opening along the second axis.

16. The scaffold of claim 10, wherein the first engagement section is operatively connected to the second engagement section by a center section, wherein the inner depending section of each of the first and second engagement sections are operatively connected to the center section.

17. The scaffold device of claim 10, having a coating material on an inner surface and an outer surface of the bracket.

18. The scaffold device of claim 10, wherein the coating material is a galvanizing material.

* * * * *